US006334040B1

(12) United States Patent
Tanaka

(10) Patent No.: US 6,334,040 B1
(45) Date of Patent: Dec. 25, 2001

(54) TRANSFER ROLLER WHOSE NON-DRIVING-SIDE END PORTION HAS A SMALLER DIAMETER

(75) Inventor: Yuko Tanaka, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/559,312

(22) Filed: Apr. 27, 2000

(30) Foreign Application Priority Data

May 10, 1999 (JP) ..... 11-128333
Feb. 21, 2000 (JP) ..... 12-042241

(51) Int. Cl.[7] ..... G03G 15/16
(52) U.S. Cl. ..... 399/313
(58) Field of Search ..... 399/313, 314, 399/318

(56) References Cited

U.S. PATENT DOCUMENTS 5,483,330 * 1/1996 Ogiyama et al. ..... 399/318
6,167,229 * 12/2000 Watanabe et al. ..... 399/313

* cited by examiner

*Primary Examiner*—William J. Royer
(74) *Attorney, Agent, or Firm*—Fitzpatrick, Cella, Harper & Scinto

(57) ABSTRACT

A contact transfer member capable of preventing ablation of an image bearing member at a side opposite to a driving side and improving durability of the image bearing member, and an image forming apparatus including the contact transfer member are provided. In the image forming apparatus including a transfer roller (the contract transfer member) having the shape of a rotating member and including an ion-conductive elastic layer contacting a photosensitive member (the image bearing member), and a transfer device for transferring a toner image on the photosensitive member onto a recording material while grasping and conveying the recording material at a transfer nip portion formed between the transfer roller and the photosensitive drum, the outer diameter of the transfer roller at a side opposite to the driving side is made smaller than the outer diameter of the transfer roller at the driving side. It is thereby possible to provide a uniform transfer-nip width in the longitudinal direction of the transfer roller, and to improve durability of the photosensitive drum by preventing ablation of the photosensitive drum at a side opposite to the driving side.

9 Claims, 6 Drawing Sheets

TRANSFER ROLLER WHOSE NON-DRIVING-SIDE END PORTION HAS A SMALLER DIAMETER

BACKGROUND OF THE INVENTION

1. Field of the Invention

The present invention relates to an image forming apparatus, such as a copier, a printer, or the like, using an electrostatic recording method or an electrophotographic recording method, and to a transfer roller which is used in such an image forming apparatus.

2. Description of the Related Art

Most conventional image forming apparatus which adopt an electrophotographic recording method use a contact transfer method whereby the generation of ozone, a material considered to be noxious, is very small. In particular, a roller transfer method having an excellent recording-material conveying property at a transfer portion has been adopted.

In the roller transfer method, a transfer nip is formed by pressing a transfer roller having an outer elastic rubber layer against a photosensitive drum, and a toner image on the photosensitive drum is transferred onto a recording material passing thru the nip by the function of a transfer bias voltage applied to the transfer roller.

Elastic sponge rollers having a hardness of 20–40° (ASKER-C), obtained by forming a conductive sponge elastic layer, and whose resistance is adjusted to a value of $1\times10^{6}$–$1\times10^{10}\Omega$ by adding carbon, ion-conductive fillers or the like, on a core made of SUS (stainless steel), Fe, or the like, are generally used as the transfer rollers. Recently, in accordance with an increasing demand from a market for printing on a variety of recording materials, there has been developed image forming apparatuses using a transfer roller made of a conductive solid rubber and having a higher conveying property.

Since the conductive-solid-rubber transfer roller uses for its elastic layer a solid rubber having a high restoring force, the roller has a recording-material holding force at a transfer nip portion having a value higher than that of the conventional sponge-type transfer roller. Hence, this roller is less influenced, for example, by back tension in sheet feeding or conveying resistance produced by friction of a post card, a thick sheet, or the like, so that more stable conveyance of a recording material can be performed. Particularly, in image forming apparatuses of a so-called rapid transfer type in which the absence of an image at a central portion is prevented by scraping off toner particles from the surface of a photosensitive drum by rapidly driving a transfer roller with respect to the photosensitive drum and feeding a recording material at a speed higher than the speed of the photosensitive drum, the conductive-solid-rubber transfer roller has the feature that changes in the recording-material conveying speed due to changes in the printing ratio are smaller than in the sponge-type transfer roller.

However, the use of such a transfer roller having a high recording-material holding force causes the following problems.

First, an outline of a surrounding portion of a transfer roller will be described with reference to FIGS. 8A–8C. As shown in FIG. 8A, a transfer roller 5 is brought in pressure contact with a photosensitive drum 1 via a bearing 5*e* by means of a pressing spring 5*d* with a constant pressure. In order to reduce the cost of the transfer roller 5 and the size of the image forming apparatus, it is effective to reduce the diameter of the transfer roller 5. In this case, however, the core of the transfer roller 5 bends as shown in FIG. 8B due to the pressure contact against the photosensitive drum 1. As a result, the widths of transfer nips at both end portions become larger than at a central portion in the longitudinal direction (see FIG. 8C). In addition, while the side of the transfer roller 5 where a gear is present tends to leave the photosensitive drum 1 due to a reaction to rotation, the contact pressure and the width of the transfer nip tend to be larger at a side of the transfer roller 5 opposite to the gear side than at the gear side. If the width of the transfer nip differs in the longitudinal direction of the transfer roller 5 as described above, a transfer current flows more easily at end portions having a longer nip width than at a central portion having a shorter nip width, thereby causing unevenness in the transfer current in the longitudinal direction of the transfer roller 5. The surface of the photosensitive drum 1 is scraped off during charging. If unevenness in the transfer current occurs in the longitudinal direction of the transfer roller 5, the ablation of the photosensitive drum 1 is accelerated at the end portion of the transfer roller 5 opposite to the driving side where charging is stronger due to a larger amount of transfer current, thereby reducing the life of the photosensitive drum 1.

The solid-rubber-type transfer roller having excellent stability in conveyance of a recording material has greater hardness than the sponge-type roller, so that the difference in the width of the transfer nip in the longitudinal direction tends to increase in the solid-rubber-type roller. As a result, the amount of ablation of the photosensitive drum at the side opposite to the driving side tends to increase, thereby tending to cause a decrease in the life of the photosensitive drum. This problem is more pronounced in a low temperature/low humidity environment where the charging potential for the photosensitive drum is high.

In one type of conductive-solid-rubber transfer roller, a so-called electron-conductive rubber material in which conductivity is provided by dispersing in the rubber inorganic conductive fillers made of carbon, or the like is used. In another type, a rubber which is provided with conductivity by dispersing an ion-conductive material, such as surface active agent, or the like, is used, or a so-called ion-conductive rubber is used.

In order to respond to a recent demand from a market toward higher picture quality, transfer rollers having an ion-conductive rubber layer have been used. These transfer rollers have excellent uniformity in resistivity within an elastic layer and are therefore more suitable for high picture quality.

Electron-conductive transfer rollers have the feature that, when the rubber is crushed, the conductive structure is disrupted, thereby increasing the resistance of the rubber in proportion to the degree of disruption. An increase in the nip width due to the disruption of the rubber is compensated for by an increase in the resistance of the rubber. As a result, the above-described ablation of the photosensitive drum at the side of the transfer roller opposite to the driving side progresses less in electron-conductive transfer rollers than in ion-conductive transfer rollers. On the other hand, in ion-conductive transfer rollers, since the conductive structure is not disrupted even if the rubber is disrupted and deformed, and the resistance of the rubber does not change, local ablation of the photosensitive drum due to unevenness in the nip width tends to occur.

SUMMARY OF THE INVENTION

It is an object of the present invention to provide a transfer roller and an image forming apparatus in which local ablation of an image bearing member can be prevented.

It is another object of the present invention to provide a transfer roller having an ion-conductive rubber layer, and an image forming apparatus using the transfer roller.

According to one aspect of the present invention, a transfer roller includes a shaft, a driving gear provided at one end side of the shaft, and an elastic layer provided on the shaft. The outer diameter of an end portion of the transfer roller opposite to the driving side is smaller than the outer diameter of an end portion of the transfer roller at the driving side.

According to another aspect of the present invention, an image forming apparatus includes an image bearing member for bearing an image, and a transfer roller for forming a nip for grasping and conveying the image bearing member and a transfer material and for transferring a toner image on the image bearing member onto the transfer material. The transfer roller includes a driving gear for receiving a driving force at one end side of the transfer roller, and the outer diameter of an end portion of the transfer roller opposite to the driving side is smaller than the outer diameter of an end portion of the transfer roller at the driving side.

The foregoing and other objects, advantages and features of the present invention will become more apparent from the following description of the preferred embodiments taken in conjunction with the accompanying drawings.

DESCRIPTION OF THE PREFERRED EMBODIMENTS

Preferred embodiments of the present invention will now be described with reference to the drawings.

First Embodiment

Figure 1:
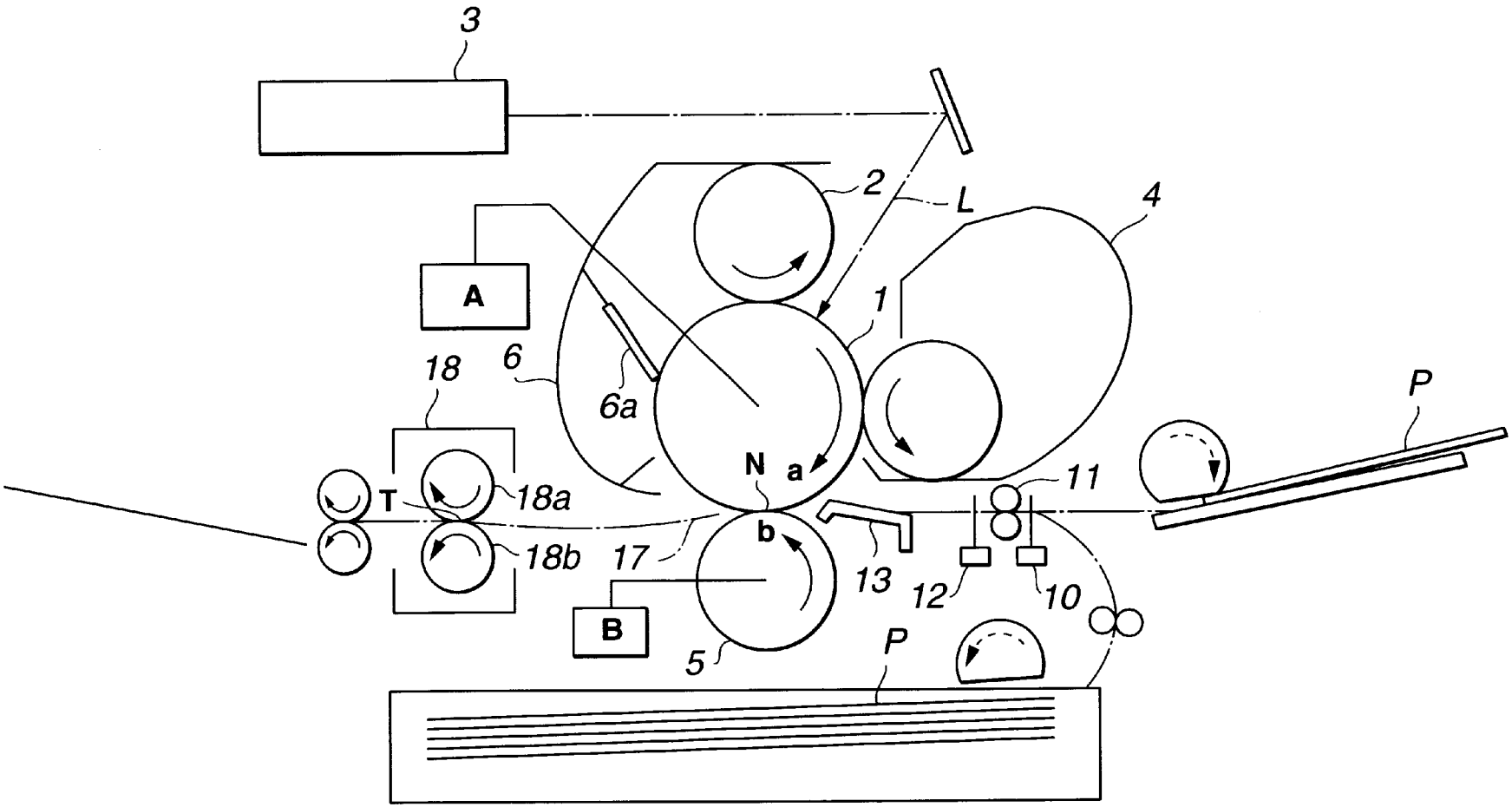
FIG. 1 is a cross-sectional view illustrating a principal portion of an image forming apparatus according to a first embodiment of the present invention.

FIG. 1 is a cross-sectional view illustrating a principal portion of an image forming apparatus according to a first embodiment of the present invention. In FIG. 1, reference numeral 1 represents a photosensitive drum, serving as an image bearing member. The photosensitive drum 1 is provided by forming a photosensitive material, such as an OPC (organic photoconductor), amorphous silicon, or the like, on a cylinder-shaped substrate made of aluminum, nickel, or the like, and is rotatably driven in the direction of an arrow "a" (a clockwise direction) at a predetermined circumferential speed by driving means A.

Charging means 2 uniformly charges the circumferential surface of the photosensitive drum 1 to a predetermined potential of a predetermined polarity. In the first embodiment, a contact charging device using a charging roller is used as the charging means.

Reference numeral 3 represents an image-information exposure means. In the first embodiment, a laser-beam scanner is used as the image-information exposure means. The laser-beam scanner 3 includes a semiconductor laser, a polygonal mirror, an F-θ lens, and the like, and performs scanning exposure of the uniformly charged surface of the photosensitive drum 1 by emitting a laser beam L subjected to on/off control in accordance with image information transmitted from a host apparatus (not shown), to form an electrostatic latent image on the photosensitive drum 1.

A developing device 4 develops the electrostatic latent image on the photosensitive drum 1, to provide a toner image. A jumping developing method, a two-component developing method, or the like, is adopted as the developing method, in which, in most cases, image exposure is combined with reversal development.

Reference numeral 5 represents a transfer roller, serving as a contact charging member in the shape of a rotating member having an elastic layer. The transfer roller 5 is brought in pressure contact with the photosensitive drum 1 to form a transfer nip portion N, and is rotatably driven in the direction of an arrow b (a counterclockwise direction) at a predetermined circumferential speed by driving means B. The configuration and the function of the transfer roller 5 will be described in detail later.

The toner image formed on the rotating photosensitive drum 1 is sequentially subjected at the transfer nip portion N to electrostatic transfer onto a recording material (transfer material) P fed from a sheet feeding unit to the transfer nip portion N.

The recording material P fed from the sheet feeding unit is fed to the transfer nip portion N (an image forming portion) via registration rollers 11, a registration sensor 12 and guide 13, after waiting at the position of a pre-feeding sensor 10. That is, the recording material P is supplied to the transfer nip portion N formed by the photosensitive drum 1 and the transfer roller 5, in a state of being synchronized with the toner image formed on the surface of the photosensitive drum 1 by the registration sensor 12.

The recording material P passing through the transfer nip portion P after the transfer of the toner image at the transfer nip portion N is separated from the surface of the photosensitive drum 1, and is conveyed to a fixing device 18 passing through a sheet path 17.

The fixing device 18 of the first embodiment is a roller-type fixing device including a pair of pressure-contact rollers, i.e., a heating roller 18*a* and a pressing roller 18*b*. The toner image on the recording material P is fixed by heat and pressure while the recording material P is grasped and conveyed at a fixing nip portion T, which is a pressure contact portion between the heating roller 18*a* and the pressing roller 18*b*. The recording material P having the toner image fixed as a permanent image is discharged to the outside of the apparatus.

The surface of the photosensitive drum 1 after the transfer of the toner image onto the recording material P is cleaned by cleaning device 6 which removes the remaining toner particles, in order to be repeatedly used for image formation. The cleaning device 6 in the first embodiment is a blade cleaning device including a cleaning blade 6*a*.

Next, the configuration and the operation of the transfer roller 5 will be described in detail with reference to FIGS. 2 through 6.

Figure 2:
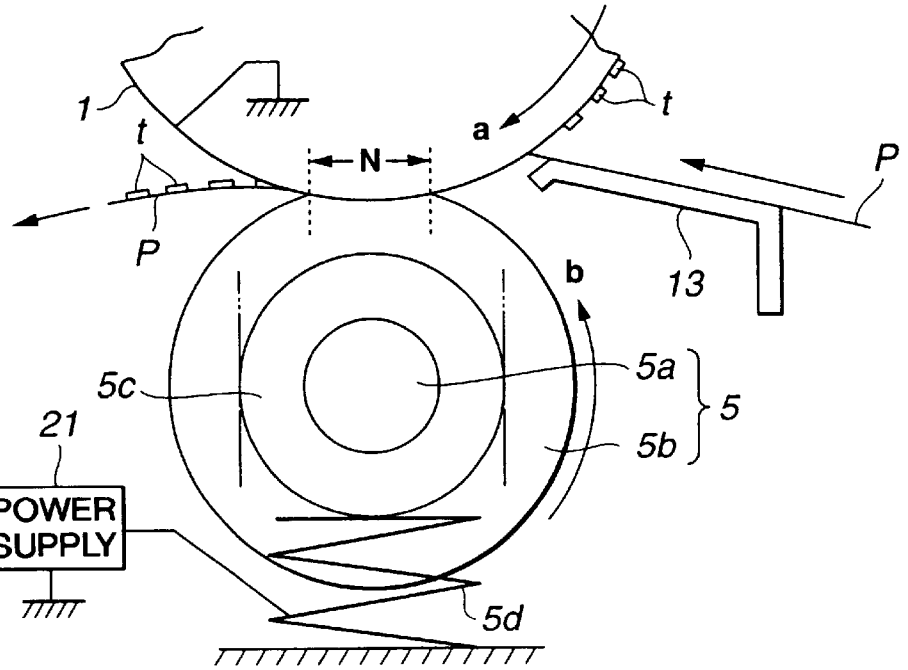
FIG. 2 is an enlarged side view illustrating a portion including a transfer roller of the image forming apparatus shown in FIG. 1.
Figure 3:
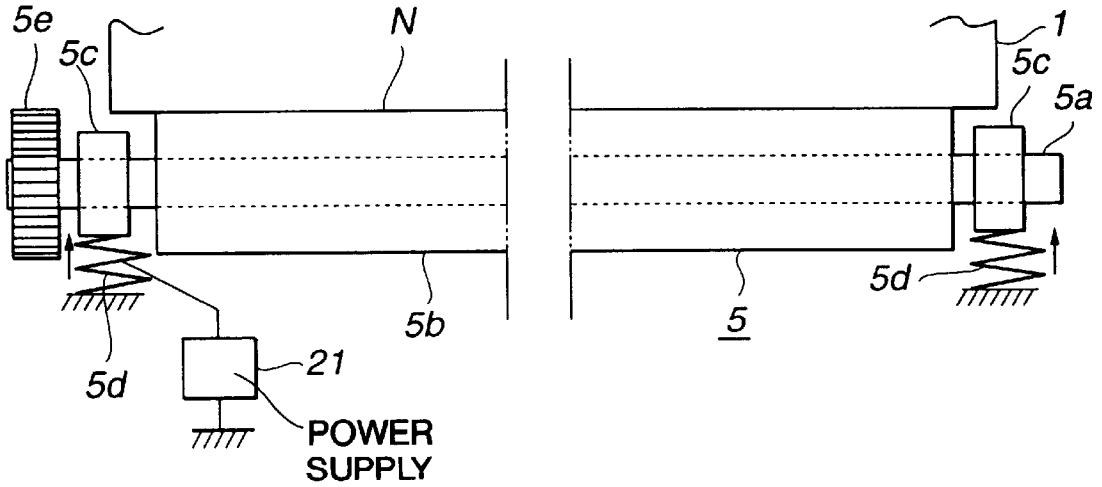
FIG. 3 is a front view illustrating the portion including the transfer roller shown in FIG. 2.
Figure 4:
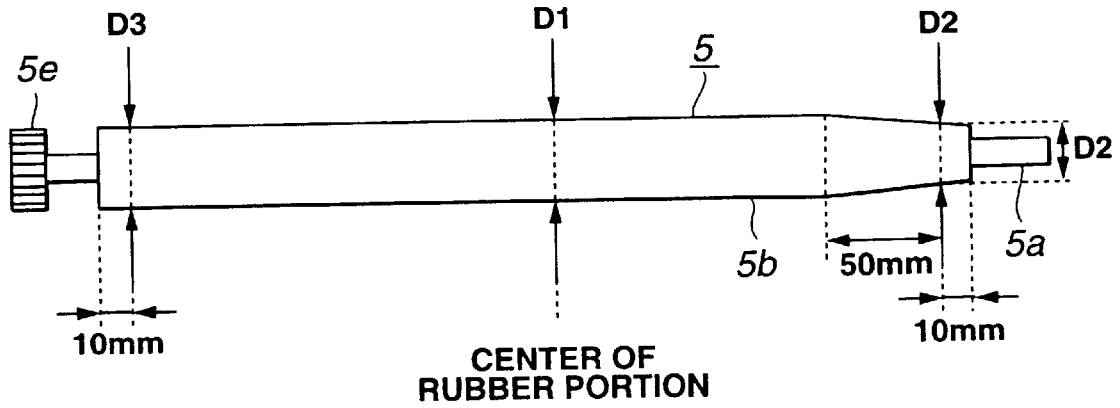
FIG. 4 is a front view of the transfer roller shown in FIGS. 2 and 3.
Figure 5:
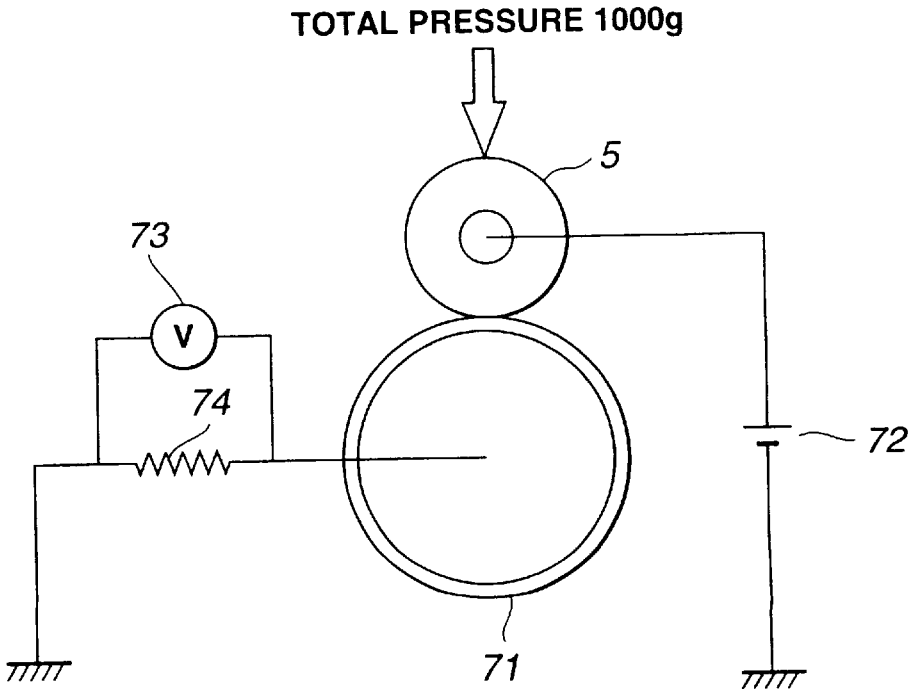
FIG. 5 is a schematic diagram illustrating a method for measuring the value of the resistance of the transfer roller.
Figure 6:
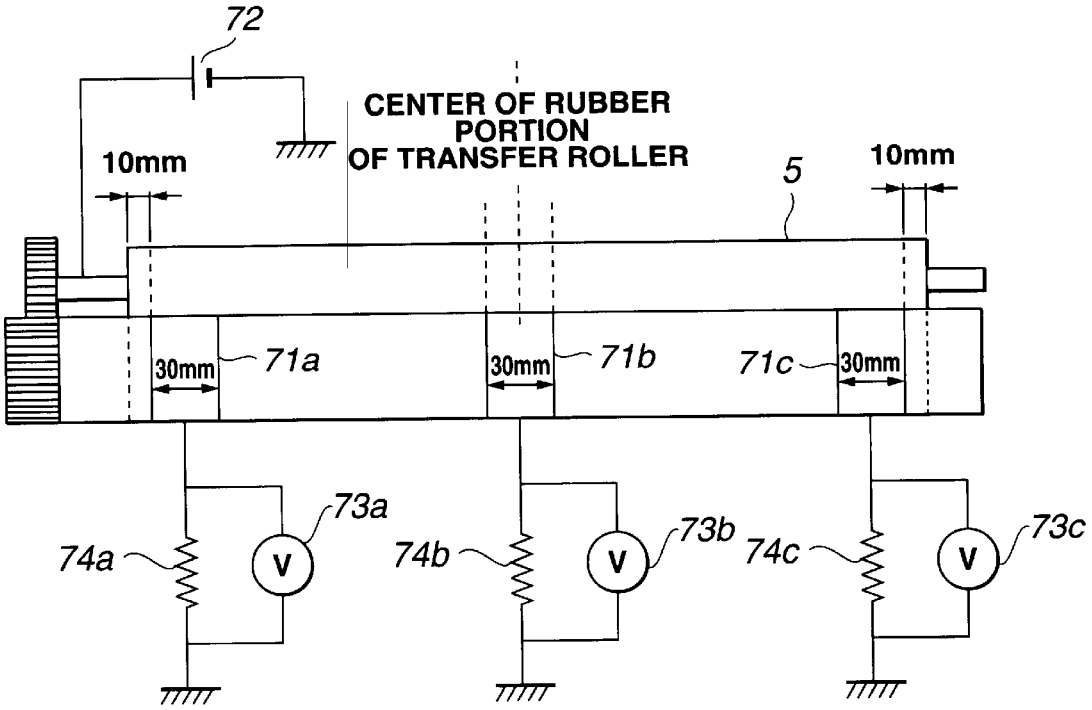
FIG. 6 is a schematic diagram illustrating a method for measuring the values of divided resistances of the transfer roller in the longitudinal direction.

FIG. 2 is an enlarged side view illustrating a portion of the first embodiment including the transfer roller 5. FIG. 3 is a front view illustrating the portion of the first embodiment including the transfer roller 5. FIG. 4 is a front view illustrating the transfer roller 5. FIG. 5 is a schematic diagram illustrating a method for measuring the value of the resistance of the transfer roller 5. FIG. 6 is a schematic diagram illustrating a method for measuring the values of divided resistances of the transfer roller 5 in the longitudinal direction.

The transfer roller 5 shown in FIGS. 2 and 3 is a solid-rubber roller provided by forming a solid medium-resistance elastic layer 5*b* made of EPDM (ethylene propylene diene monomer), silicone, NBR (acrylonitrile-butadiene rubber), urethane, or the like, on a core 5*a* made of iron, SUS, or the like. A roller having a hardness of 40–70° (ASKER-C at a load of 1 kg) and a resistance of $10^6$–$10^{10}\Omega$ is used. The elastic layer 5*b* of the transfer roller 5 is provided by performing secondary vulcanization after performing primary vulcanization, and then polishing the surface to provide a desired value of the outer diameter, followed by heating the surface.

The transfer roller 5 used in the first embodiment is a solid (filled) conductive elastic roller, having a hardness of 60° (ASKER-C at a total load of 1,000 g), a central-portion outer diameter of 16 mm, and a rubber-portion length of 216 mm, provided by forming the elastic layer (medium-resistance elastic layer) 5*b*, made of an NBR-type ion-conductive solid rubber having a resistance of $5\times10^8\Omega$, on the core 5*a* having a diameter of 6mm and made of Fe.

The method for manufacturing the transfer roller 5 will now be briefly described.

Elastic layer 5*b* is formed by performing injection molding, press molding or extrusion molding of an NBR-type ion-conductive rubber on the core 5*a* according to press fitting or the like, and following that formation, primary vulcanization was performed. In the first embodiment, the elastic layer 5*b* was formed by injection molding, and primary vulcanization was performed within the injection forming die at 140° C. for 30 minutes.

Then, the transfer roller 5 is taken out from the forming die, and secondary vulcanization is performed in a continuous furnace, a batch furnace, or the like. In the first embodiment, secondary vulcanization was performed in a batch furnace at 160° C. for 60 minutes. Then, the elastic layer 5*b* is polished, to provide a desired value of the outer diameter. In the first embodiment, as shown in FIG. 4, the outer diameter at an end of the transfer roller 5 opposite to the driving end in the longitudinal direction is polished to a value smaller than the outer diameter in other portions. More specifically, polishing was performed so as to provide a tapered shape from a portion 50 mm from the end portion opposite to the driving side to that end portion, and therefore to provide a smaller diameter at the end portion than at a central portion of the transfer roller 5.

A surface heating treatment, such as an UV (ultraviolet light) treatment, or the like, is performed on the surface as finishing after polishing. In the first embodiment, UV processing consisted of light from an ultraviolet lamp emitting light having a wavelength of about 250 nm being projected for 3 minutes. This UV processing prevents adherence of paper powder, and other similar contaminants, to the rubber surface of the transfer roller 5.

As shown in FIG. 3, the transfer roller 5 is disposed parallel to the photosensitive drum 1. Each end portion of the core 5*a* is rotatably held by a bearing member 5*c* and is urged in the direction of the photosensitive drum 1 by a pressing spring 5*d*. The elastic layer 5*b* of the transfer roller 5 is brought in pressure contact with the photosensitive drum 1 with a total pressure of 0.5–2.0 kg, in order to form the transfer nip portion N.

As shown in FIG. 3, a gear 5*e* is fixed at one end portion of the core 5*a* of the transfer roller 5, and a drive gear (not shown) is meshed with the gear 5*e*. By transmitting the driving force of the drive gear to the gear 5*e*, the transfer roller 5 rotatably driven in the direction of the arrow b (a counterclockwise direction) shown in FIG. 2 at a predetermined circumferential speed.

The outer circumferential speed of the photosensitive drum 1 is set to 99% of the process speed. The calculated outer circumferential speed of the transfer roller 5 obtained from the respective outer diameters of the photosensitive drum 1 and the transfer roller 5 and the gear ratio of gears for driving these two components is set to 102% of the process speed. By thus rotating the transfer roller 5 faster than the photosensitive drum 1, and conveying the recording material P by providing a speed difference with respect to the outer circumferential speed of the photosensitive drum 1, an effect of scraping off toner particles on the photosensitive drum 1 is provided. This effect is provided in order to prevent the occurrence of an absence of an image in a central portion of transfer rollers.

In FIG. 2, reference numeral 21 represents a power supply for applying a transfer bias voltage. The transfer bias voltage is applied to the transfer roller 5 via the pressing spring 5*d*, the bearing member 5*c* and the core 5*a*, all of which are conductive. While the recording material P fed from the sheet feeding unit to the transfer nip portion N at a predetermined control timing is grasped and conveyed at the transfer nip portion N, a desired voltage having a polarity of the toner image on the photosensitive drum 1 is applied from the transfer-bias-voltage applying power supply 21 to the transfer roller 5. As a result, electric charges are provided within the transfer nip portion N so that the toner image t on the photosensitive drum 1 is subjected to electrostatic transfer.

As shown in FIG. 5, the transfer roller 5 is rotated while contacting it to an aluminum cylinder 71 with a total pressure of 1,000 g (500 g to each component), and an arbitrary voltage (for example, +2.0 kV) is applied from a DC high-voltage power supply 72 to the core 5*a* of the transfer roller 5. The maximum value and the minimum value of the voltage generated between both ends of a resistor 74 are read by a voltmeter 73. The mean value of the current flowing in the circuit is obtained from the read voltage values, and the value of the resistance of the transfer roller 5 is calculated from the obtained mean value (the measurement is performed in an environment of a temperature of 20° C., and a humidity of 60%).

As shown in FIG. 6, the value of the resistance of the transfer roller 5 may be calculated by using cylinders 71*a*, 71*b* and 71*c* divided in he longitudinal direction, instead of the electrode of the aluminum cylinder 71 of the resistance measuring apparatus shown in FIG. 5, and measuring the difference between the values of current flowing in the longitudinal direction when the transfer roller 5 is rotated while being brought in pressure contact with the cylinders 71*a*, 71*b* and 71*c* (the measurement is performed in an environment of a temperature of 20° C., and a humidity of 60%). In FIG. 6, resistors 74*a*, 74*b* and 74*c* correspond to cylinders 71*a*, 71*b* and 71*c*, and voltmeters 73*a*, 73*b* and 73*c* correspond to cylinders 71*a*, 71*b* and 71*c*.

Table 1 illustrates the results of measuring the relationship between the amount of taper (the difference between the outer diameter of a central portion and the outer diameter of the end portion that is opposite to the gear) of the transfer roller, and the width of the transfer nip in the longitudinal direction. Table 2 illustrates the results of measuring the relationship between the amount of taper of the transfer roller and the values of current flowing at a central portion and end portions when a voltage of 2 kV is applied by the above-described resistance measuring apparatus. Table 3 illustrates the results of measuring the relationship between the amount of taper of the transfer roller and the amount of ablation of the photosensitive drum after repeated image forming operations when each type of transfer roller is used. The amount of taper is obtained by subtracting an outer diameter D2 from an outer diameter D1 (=D3) shown in FIG. 4, and dividing the result of the subtraction by 2 (since the outer diameters of end portions of the rubber surface of the transfer roller are unstable due to bounding, and the like, produced during polishing, the outer diameters at inner portions separated by 10 mm from respective ends are made D2 and D3).

The amount of taper (mm)=(D1−D2)/2.

The amount of ablation of the photosensitive drum shown in Table 3was obtained by using an image forming apparatus having a process speed of 90 mm/sec, measuring the thickness of the photosensitive drum after forming images for the life of the cartridge (for 10,000 sheets in the first embodiment) by intermittently feeding sheets at a rate of one sheet per 15 seconds under a low-temperature/low humidity environment using a film-thickness meter, and calculating the amount of ablation from the amount of the thickness measured before starting the image forming operations. In each table, data obtained when using a straight roller having no difference in the outer diameter in the longitudinal direction as the transfer roller is shown as comparative data.

TABLE 1

| Amount of taper | Transfer-gear side | Center | Side opposite to the gear |
|---|---|---|---|
| 50 μm | 1.3 mm | 1.2 mm | 1.8 mm |
| 100 μm | 1.3 mm | 1.2 mm | 1.5 mm |
| 150 μm | 1.3 mm | 1.2 mm | 1.3 mm |
| 200 μm | 1.3 mm | 1.2 mm | 1.1 mm |
| 250 μm | 1.3 mm | 1.2 mm | 0.5 mm |
| None | 1.3 mm | 1.2 mm | 2.1 mm |

TABLE 2

| Amount of taper | Transfer-gear side | Center | Side opposite to the gear |
|---|---|---|---|
| 50 μm | 0.6 μA | 0.55 μA | 0.83 μA |
| 100 μm | 0.6 μA | 0.55 μA | 0.69 μA |
| 150 μm | 0.6 μA | 0.55 μA | 0.60 μA |
| 200 μm | 0.6 μA | 0.55 μA | 0.51 μA |
| 250 μm | 0.6 μA | 0.55 μA | 0.23 μA |
| None | 0.6 μA | 0.55 μA | 0.92 μA |

TABLE 3

| Amount of taper | Transfer-gear side | Center | Side opposite to the gear |
|---|---|---|---|
| 50 μm | 17 μm | 15 μm | 23 μm |
| 100 μm | 17 μm | 15 μm | 19 μm |
| 150 μm | 17 μm | 15 μm | 17 μm |
| 200 μm | 17 μm | 15 μm | 14 μm |
| 250 μm | 17 μm | 15 μm | 6 μm |
| None | 17 μm | 15 μm | 25 μm |

As is apparent from Table 1, as the outer diameter of the side of the transfer roller opposite to the gear becomes smaller than the outer diameters of other portions, the width of the transfer nip becomes more uniform. In the image forming apparatus of the first embodiment, by making the outer diameter at the side of the transfer roller opposite to the gear smaller than the outer diameters of other portions by an amount equal to or more than 300 μm, the width of the transfer nip becomes substantially uniform. However, if the outer diameter at the side of the transfer roller opposite to the gear is made smaller than the central portion by an amount equal to or more than 400 μm, the transfer nip at the side of the transfer roller opposite to the gear becomes narrower than the transfer nips of other portions, thereby causing a failure in image transfer or a failure in conveyance due to insufficient transfer current.

As shown in Tables 2 and 3, the value of the current flowing in the transfer roller changes in proportion to the width of the transfer nip, and as the width of the transfer nip becomes larger and the value of the flowing current is larger, the amount of ablation of the photosensitive drum is larger. In the conventional taper-less transfer roller, the value of the current flowing at the side of the transfer roller opposite to the gear is 1.8 times the value of the current flowing at the central portion. In this case, a failure in the obtained image occurs slightly after half of the life of the cartridge. In the image forming apparatus of the first embodiment, since a failure in the obtained image occurs when the photosensitive drum is subjected to ablation in an amount equal to or more than 20 μm, the amount of taper at the side of the transfer roller opposite to the gear is set to a value within a range of 100–200 μm.

As described above, by causing the rubber portion at the side of the transfer roller opposite to the gear to have a tapered shape in order to prevent an increase in the width of the transfer nip at the side of the transfer roller opposite to the gear, it is possible to minimize ablation of the photosensitive drum at the side of the transfer roller opposite to the gear, and thereby to increase the lives of the photosensitive drum and the cartridge.

Second Embodiment

Figure 7:
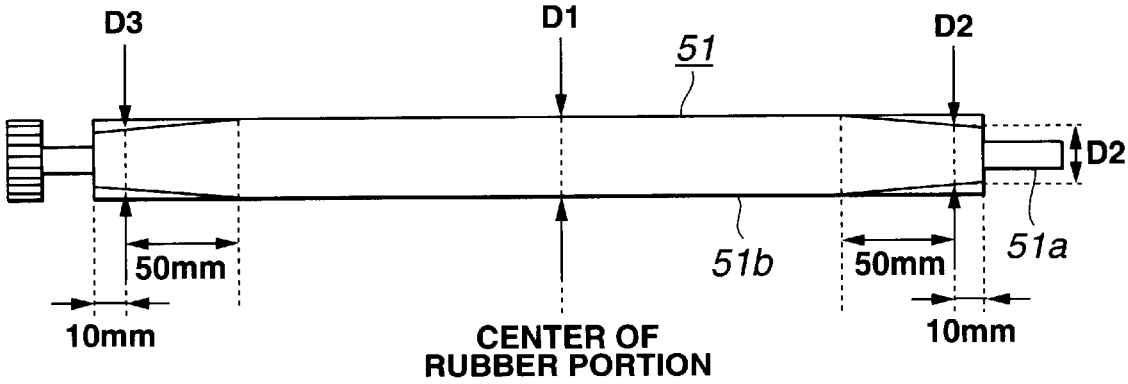
FIG. 7 is a schematic cross-sectional view illustrating a transfer roller according to a second embodiment of the present invention.
Figure 8A:
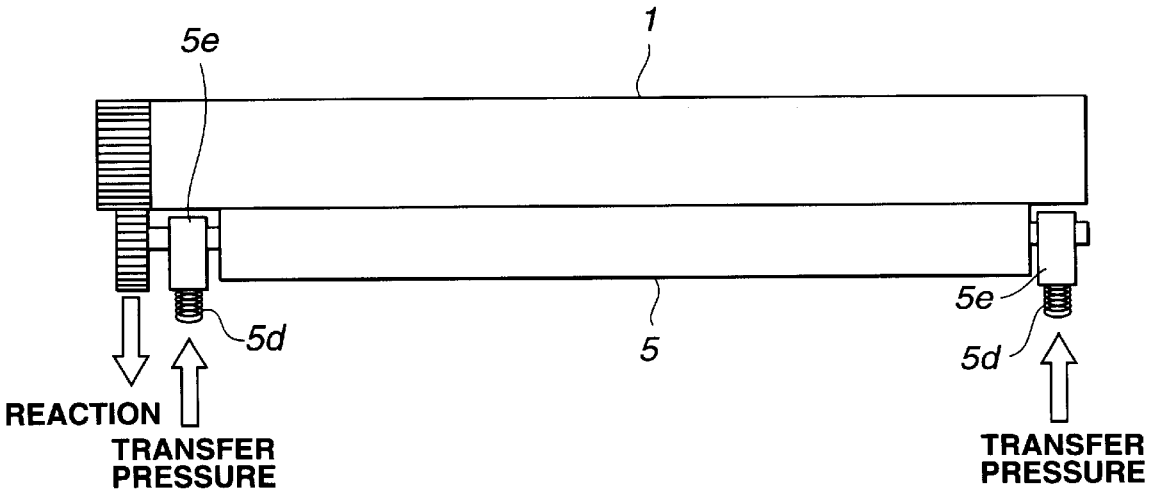
FIGS. 8A–8C are diagrams illustrating the relationship between a force applied to a transfer roller and the width of a transfer nip.
Figure 8B:
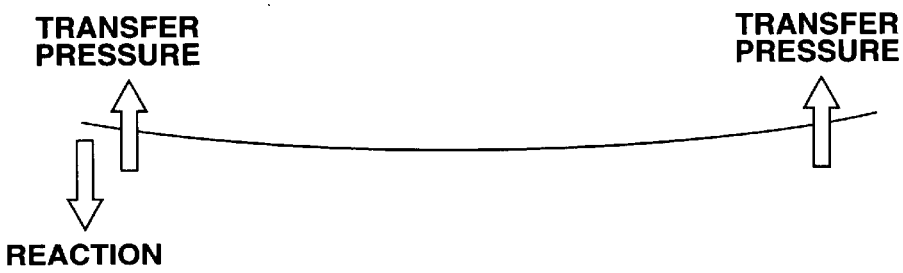
Figure 8C:
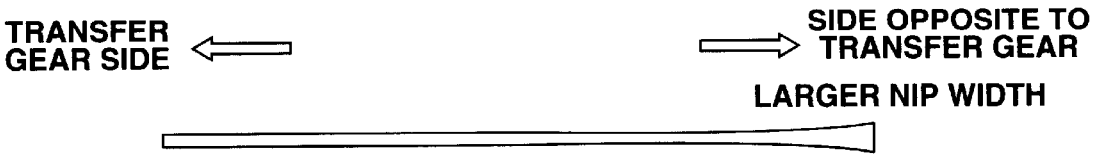

FIG. 7 illustrates a transfer roller according to a second embodiment of the present invention.

Since the image forming apparatus using this transfer roller is the same as that shown in FIG. 1, further description thereof will be omitted.

A transfer roller 51 shown in FIG. 7 is a solid-rubber roller provided by forming a solid medium-resistance elastic layer 51*b* made of EPDM, silicone, NBR urethane, or the like, on a core 51*a* made of iron, SUS, or the like. A roller having a hardness of 40–70° (ASKER-C at a load of 1 kg) and a resistance of $10^6$–$10^{10}$ Ω is used. The elastic layer 51*b* of the transfer roller 51 is provided by performing secondary vulcanization after performing primary vulcanization, and then polishing the surface to provide a desired value of the outer diameter, followed by heating the surface.

The transfer roller 51 used in the second embodiment is a solid (filled) conductive elastic roller, having a hardness of 60° (ASKER-C at a total load of 1,000 g), a central-portion outer diameter of 16 mm, and a rubber-portion length of 216 mm, provided by forming the elastic layer (medium-resistance elastic layer) 51*b*, made of an NBR-type ion-conductive solid rubber having a resistance of $1\times10^8$Ω, on the core 51*a* having a diameter of 6 mm made of Fe.

The method for manufacturing the transfer roller 51 will now be briefly described.

After forming the elastic layer 51*b* obtained by performing injection molding, press molding or extrusion molding of an NBR-type ion-conductive rubber on the core 51*a* according to press fitting, or the like, primary vulcanization was performed. In the second embodiment, the elastic layer 51*b* was formed by injection molding, and primary vulcanization was performed within the injection forming die at 140° C. for 30 minutes.

Then, the transfer roller 51 is taken out from the forming die, and secondary vulcanization is performed in a continuous furnace, a batch furnace, or the like. In the second embodiment, secondary vulcanization was performed in a batch furnace at 160° C. for 60 minutes. Then, the elastic layer 51*b* is polished, to provide a desired value of the outer diameter. In the second embodiment, as shown in FIG. 7, the outer diameters at both sides of the transfer roller 51 in the longitudinal direction are polished to values smaller than in central portion of the transfer roller, and the outer diameter of the side of the transfer roller opposite to the driving side is made smaller than the outer diameter of the driving side of the transfer roller.

Table 4 illustrates the relationship between the amount of taper of the transfer roller, and the width of the transfer nip in the longitudinal direction and the values of currents flowing at a central portion and end portions when a voltage of 2 kV is applied by the above-described resistance measuring apparatus. The amount of taper is obtained by subtracting an outer diameter D2 (the outer diameter at the side of the transfer roller opposite to the driving side) or D3 (the outer diameter at the driving side of the transfer roller) from a diameter D1 (the outer diameter of a central portion of the transfer roller) shown in FIG. 7, and dividing the result of the subtraction by 2. Since the outer diameters of end portions of the rubber surface of the transfer roller are unstable due to bounding, and the like, produced during polishing, the outer diameters at inner portions separated by 10 mm from respective end portions are made D2 and D3.

The amount of taper (mm) at the side of the transfer roller opposite to the driving side=(D1−D2)/2 .

The amount of taper (mm) at the driving side of the transfer roller=(D1−D3)/2.

urged strongly into contact with the photosensitive member, so that an excessive current flows at the central portion of the transfer roller.

The numeral shown in each parenthesis in Table 4 represent the value of the current flowing at the corresponding portion of the transfer roller. It can be understood from Table 4 that, when unevenness in the width of the transfer nip is dissolved, current flows uniformly at respective portions.

In the image forming apparatus of the second embodiment, when the transfer current is excessive, the transfer current flows to the photosensitive drum in accordance with unevenness in the resistance of the transfer material. As a result, the potential of a portion of the photosensitive drum where an excessive current flows because the resistance of the transfer material is low is reduced, thereby producing a punch-through image in which a black point appears in a halftone image at the succeeding printing operation. On the other hand, when the transfer current is insufficient, a failure in image transfer occurs. In the image forming apparatus of the second embodiment, the difference between the value of the current causing a punch-through image and the value of the current causing a failure in image transfer is about 2 $\mu$A. In consideration of tolerance in the transfer current due to variations during the manufacture of transformers for outputting a transfer voltage, it is necessary to suppress variations in the transfer current in the longitudinal direction of the transfer roller to a value less than 1 $\mu$A, and more preferably, equal to or less than 0.5 $\mu$A.

The results shown in Table 4 indicates that, in the image forming apparatus of the second embodiment, by making the amount of taper at the side of the transfer roller opposite to the driving side to a value of about 150–200 $\mu$m and setting the amount of taper at the driving side to a value smaller than the above-described value by 50–100 $\mu$m, the transfer nip becomes substantially uniform, and the problems in the obtained image caused by variations in the transfer current are resolved.

By performing printing using a transfer roller having an amount of taper at the side opposite to the driving side of 150 $\mu$m and an amount of taper at the driving side of 100 $\mu$m, an excellent image which does not have a punch-through portion or a failure in image transfer in both character portions and halftone portions was obtained.

TABLE 4

| Amount of taper of the transfer roller | | Width of the transfer nip | | |
|---|---|---|---|---|
| Driving side | Side opposite to the driving side | End portion at the driving side | Central portion | End portion at the side opposite to the driving side |
| 0 | 0 | 1.6 mm(6.4 $\mu$A) | 0.8 mm(3.2 $\mu$A) | 2.1 mm(8.4 $\mu$A) |
| 50 $\mu$m | 50 $\mu$m | 1.4 mm(6.0 $\mu$A) | 1.0 mm(4.3 $\mu$A) | 1.8 mm(7.7 $\mu$A) |
| 100 $\mu$m | 100 $\mu$m | 1.2 mm(5.4 $\mu$A) | 1.2 mm(5.4 $\mu$A) | 1.6 mm(7.2 $\mu$A) |
| 150 $\mu$m | 150 $\mu$m | 1.0 mm(5.0 $\mu$A) | 1.3 mm(6.5 $\mu$A) | 1.3 mm(6.5 $\mu$A) |
| 200 $\mu$m | 200 $\mu$m | 0.7 mm(3.9 $\mu$A) | 1.4 mm(7.6 $\mu$A) | 1.15 mm(6.4 $\mu$A) |
| 250 $\mu$m | 250 $\mu$m | 0.5 mm(3.1 $\mu$A) | 1.55 mm(9.53 $\mu$A) | 0.9 mm(5.5 $\mu$A) |
| 0 $\mu$m | 150 $\mu$m | 1.6 mm(7.2 $\mu$A) | 1.1 mm(5.0 $\mu$A) | 1.3 mm(5.9 $\mu$A) |
| 50 $\mu$m | 150 $\mu$m | 1.4 mm(6.5 $\mu$A) | 1.2 mm(5.5 $\mu$A) | 1.3 mm(6.0 $\mu$A) |
| 100 $\mu$m | 150 $\mu$m | 1.2 mm(5.8 $\mu$A) | 1.2 mm(5.8 $\mu$A) | 1.3 mm(6.3 $\mu$A) |
| 100 $\mu$m | 200 $\mu$m | 1.2 mm(6.1 $\mu$A) | 1.2 mm(6.1 $\mu$A) | 1.15 mm(5.8 $\mu$A) |

As is apparent from Table 4, as the outer diameters at both ends of the transfer roller are smaller than the outer diameter at the central portion of the transfer roller, the contact of the transfer roller with the photosensitive drum due to the deflection of the transfer roller is improved, so that the nip at end portions of the transfer roller becomes narrower and the transfer nip becomes uniform. However, if the amount of taper is too large, the central portion of the transfer roller is As described above, reduction of the outer diameter at end portions than at a central portion of a transfer roller by providing tapered portions at both ends of a rubber portion of the transfer roller, and reduction of the outer diameter at a side of the transfer roller opposite to the driving side in comparison to the driving side of the transfer roller are very effective for an apparatus having a large nip pressure, or an apparatus in which a transfer current is large and a photosensitive member tends to be scraped off.

The individual components shown in outline in the drawings are all well known in the transfer roller arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims.

What is claimed is:

1. A transfer roller comprising:

a shaft having a driving end and an end opposite to the driving end;

a driving gear provided at the driving end of said shaft; and an elastic layer provided on said shaft to form said transfer roller, said transfer roller having a driving end portion near the driving end of said shaft and an opposite end portion near the end opposite to the driving end of said shaft, wherein an outer diameter of the opposite end portion of said transfer roller is smaller than an outer diameter of the driving end portion of said transfer roller.

2. A transfer roller according to claim 1, wherein said transfer roller comprises a tapered portion at the opposite end portion.

3. A transfer roller according to claim 1, wherein said transfer roller comprises tapered portions at both end portions.

4. A transfer roller according to claim 1, wherein said elastic layer is an ion-conductive rubber layer.

5. An image forming apparatus comprising:

an image bearing member for bearing an image; and a transfer roller for forming a nip with said image bearing member for grasping and conveying a transfer material and for transferring a toner image on said image bearing member onto the transfer material, wherein said transfer roller comprises a driving end portion and an opposite end portion opposite to the driving end portion and a driving gear provided at the driving end portion side, and wherein an outer diameter of the opposite end portion of said transfer roller is smaller than the outer diameter of the driving end portion of said transfer roller.

6. An apparatus according to claim 5, wherein the opposite end portion of said transfer roller comprises a tapered portion.

7. An apparatus according to claim 5, wherein both end portions of said transfer roller comprises tapered portions.

8. An apparatus according to claim 5, wherein said transfer roller has an ion-conductive rubber layer.

9. An apparatus according to claim 5, wherein said image bearing member has the shape of a drum, and comprises a drum gear engaged with said driving gear at an end portion of said image bearing member.

* * * * *

UNITED STATES PATENT AND TRADEMARK OFFICE

CERTIFICATE OF CORRECTION

PATENT NO. : 6,334,040 B1
DATED : December 25, 2001
INVENTOR(S) : Yuko Tanaka

It is certified that error appears in the above-identified patent and that said Letters Patent is hereby corrected as shown below:

Column 10,
Line 5, "resent" should read -- resents --.
Line 28, "indicates" should read -- indicate --.

Signed and Sealed this

Twenty-third Day of April, 2002

*Attest:*

*Attesting Officer*

JAMES E. ROGAN
*Director of the United States Patent and Trademark Office*